US010703621B1

(12) United States Patent
Vanston

(10) Patent No.: US 10,703,621 B1
(45) Date of Patent: Jul. 7, 2020

(54) FUEL PUMP HOLDING STRAP

(71) Applicant: Richard Vanston, Middleboro, MA (US)

(72) Inventor: Richard Vanston, Middleboro, MA (US)

( * ) Notice: Subject to any disclaimer, the term of this patent is extended or adjusted under 35 U.S.C. 154(b) by 0 days.

(21) Appl. No.: 16/411,218

(22) Filed: May 14, 2019

(51) Int. Cl.
*B67D 7/04* (2010.01)

(52) U.S. Cl.
CPC ..... *B67D 7/04* (2013.01)

(58) Field of Classification Search
USPC ..... 141/392; 248/75–88
See application file for complete search history.

(56) References Cited

U.S. PATENT DOCUMENTS 1,302,086 A 4/1919 Pitlick
1,441,154 A * 1/1923 Johnson ..... F16L 33/035 24/20 R
1,482,564 A * 2/1924 Isachson ..... F16L 33/04 24/285
3,851,979 A * 12/1974 Becker ..... F16L 3/14 403/76
4,176,695 A 12/1979 Raske
4,874,151 A 10/1989 Fritz
D319,383 S 8/1991 Kihlstrom
7,909,304 B1 3/2011 Lombardo
2006/0185765 A1 8/2006 Bates
2007/0267101 A1* 11/2007 Wong ..... A62C 5/02 141/382

FOREIGN PATENT DOCUMENTS

GB 2319514 5/1998

* cited by examiner

*Primary Examiner* — Craig M Schneider
*Assistant Examiner* — Jason K Niesz

(57) ABSTRACT

The fuel pump holding strap is a mechanical device. The fuel pump holding strap is configured for use with a vehicle. The vehicle further comprises a metal mesh screen flooring. The metal mesh screen flooring forms a platform commonly used by the operator of a vehicle for entering and exiting the vehicle. The fuel pump holding strap is configured for use with a fuel pump nozzle. The fuel pump nozzle is a nozzle configured for use in dispensing fuel into the vehicle. The fuel pump holding strap comprises a pipe clamp and a plurality of fastening structures. The pipe clamp attaches the plurality of fastening structures to the fuel pump nozzle. The plurality of fastening structures secures the fuel pump nozzle to the metal mesh screen flooring such that the fuel pump nozzle does dislodge during the fuel transfer process.

19 Claims, 5 Drawing Sheets

FUEL PUMP HOLDING STRAP

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of transportation including liquid handling devices and nozzles, more specifically, a detail of a device for transferring liquid from bulk storage to a vehicle. (B67D7/06)

SUMMARY OF INVENTION

The fuel pump holding strap is a mechanical device. The fuel pump holding strap is configured for use with a vehicle. The vehicle further comprises a metal mesh screen flooring. The metal mesh screen flooring forms a platform commonly used by the operator of a vehicle for entering and exiting the vehicle. The fuel pump holding strap is configured for use with a fuel pump nozzle. The fuel pump nozzle is a nozzle configured for use in dispensing fuel into the vehicle. The fuel pump holding strap comprises a pipe clamp and a plurality of fastening structures. The pipe clamp attaches the plurality of fastening structures to the fuel pump nozzle. The plurality of fastening structures secures the fuel pump nozzle to the metal mesh screen flooring such that the fuel pump nozzle does dislodge during the fuel transfer process.

These together with additional objects, features and advantages of the fuel pump holding strap will be readily apparent to those of ordinary skill in the art upon reading the following detailed description of the presently preferred, but nonetheless illustrative, embodiments when taken in conjunction with the accompanying drawings.

In this respect, before explaining the current embodiments of the fuel pump holding strap in detail, it is to be understood that the fuel pump holding strap is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the fuel pump holding strap.

It is therefore important that the claims be regarded as including such equivalent construction insofar as they do not depart from the spirit and scope of the fuel pump holding strap. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
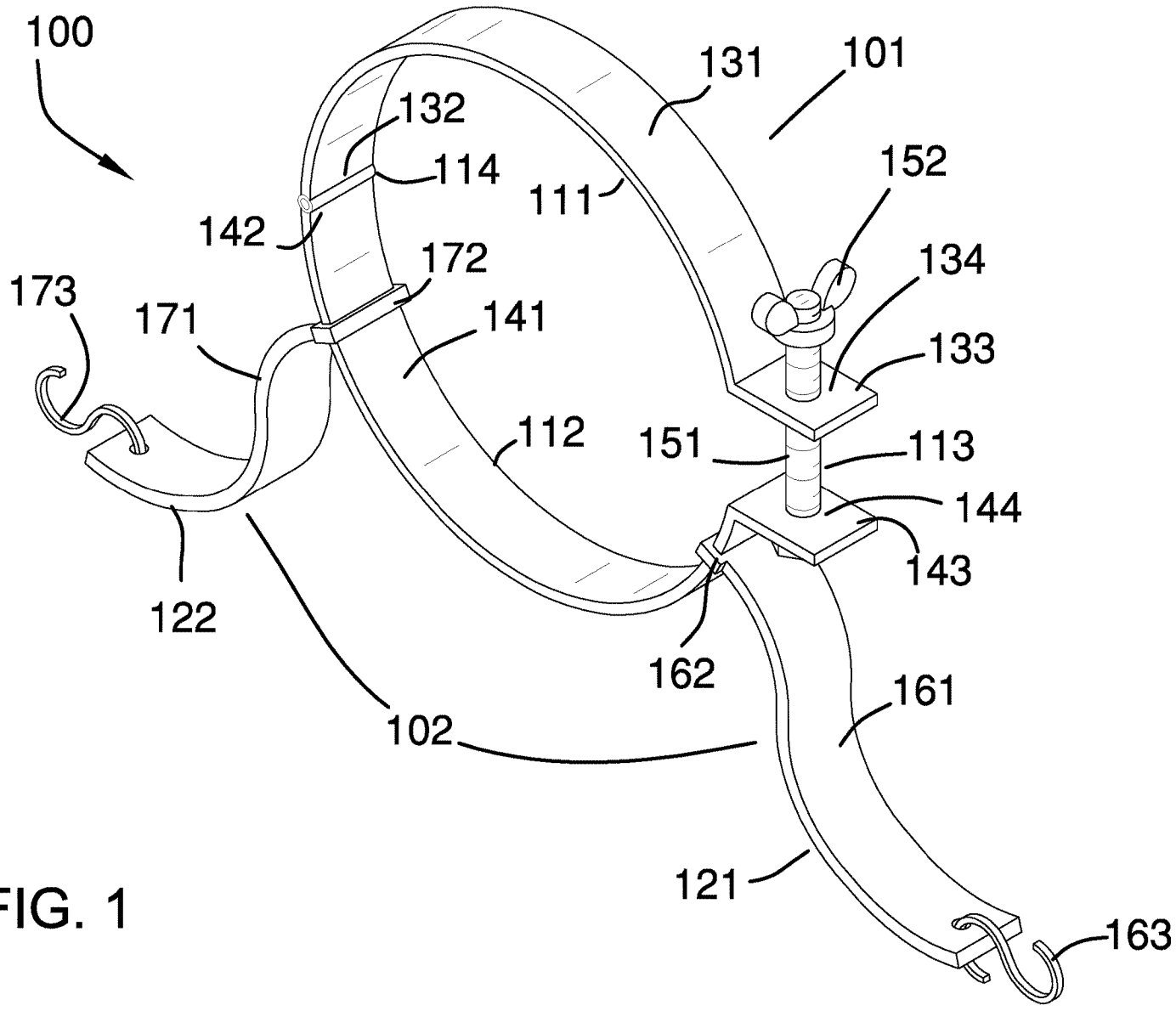
FIG. 1 is a perspective view of an embodiment of the disclosure.
Figure 2:
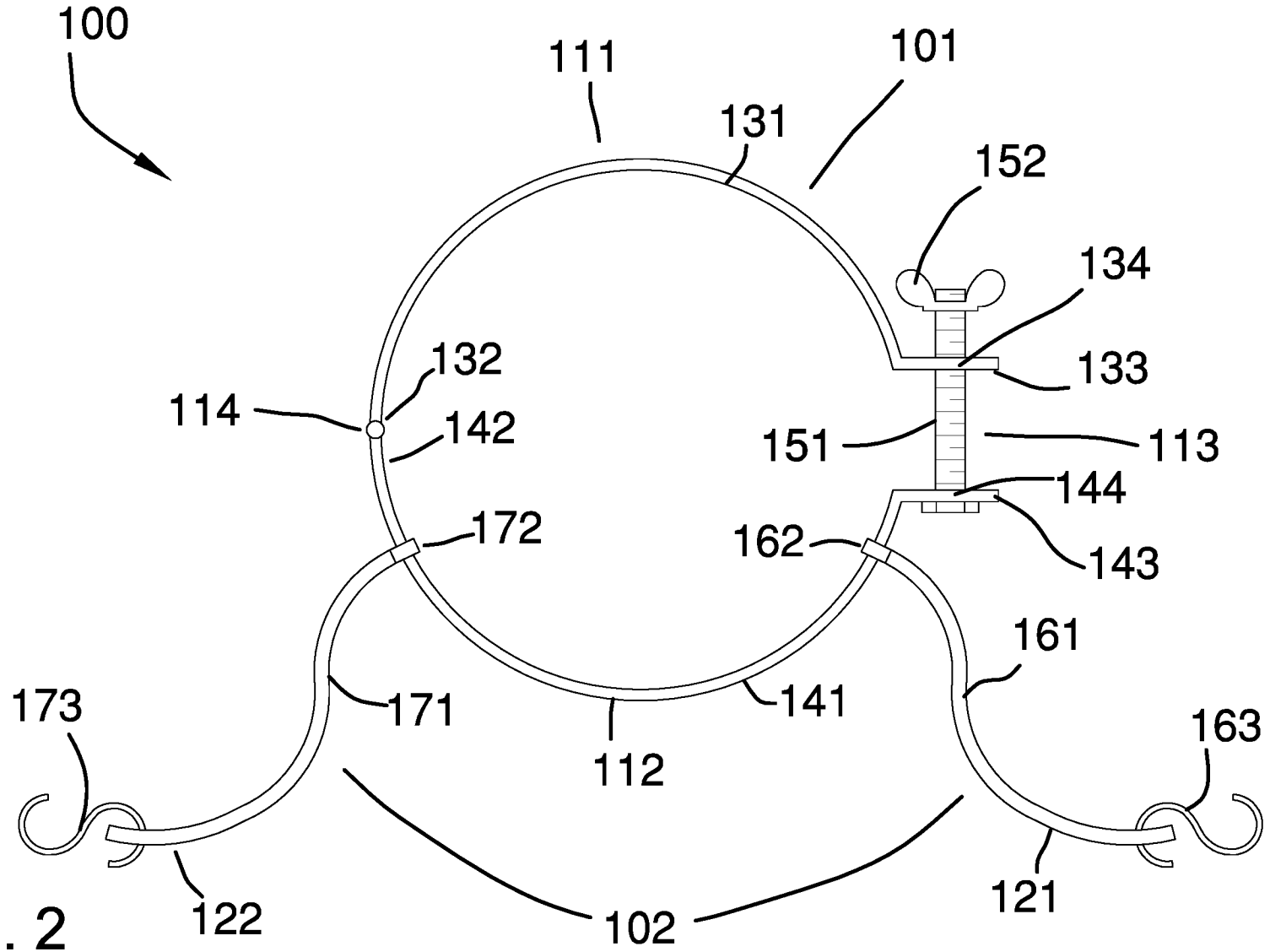
FIG. 2 is a front view of an embodiment of the disclosure.
Figure 3:
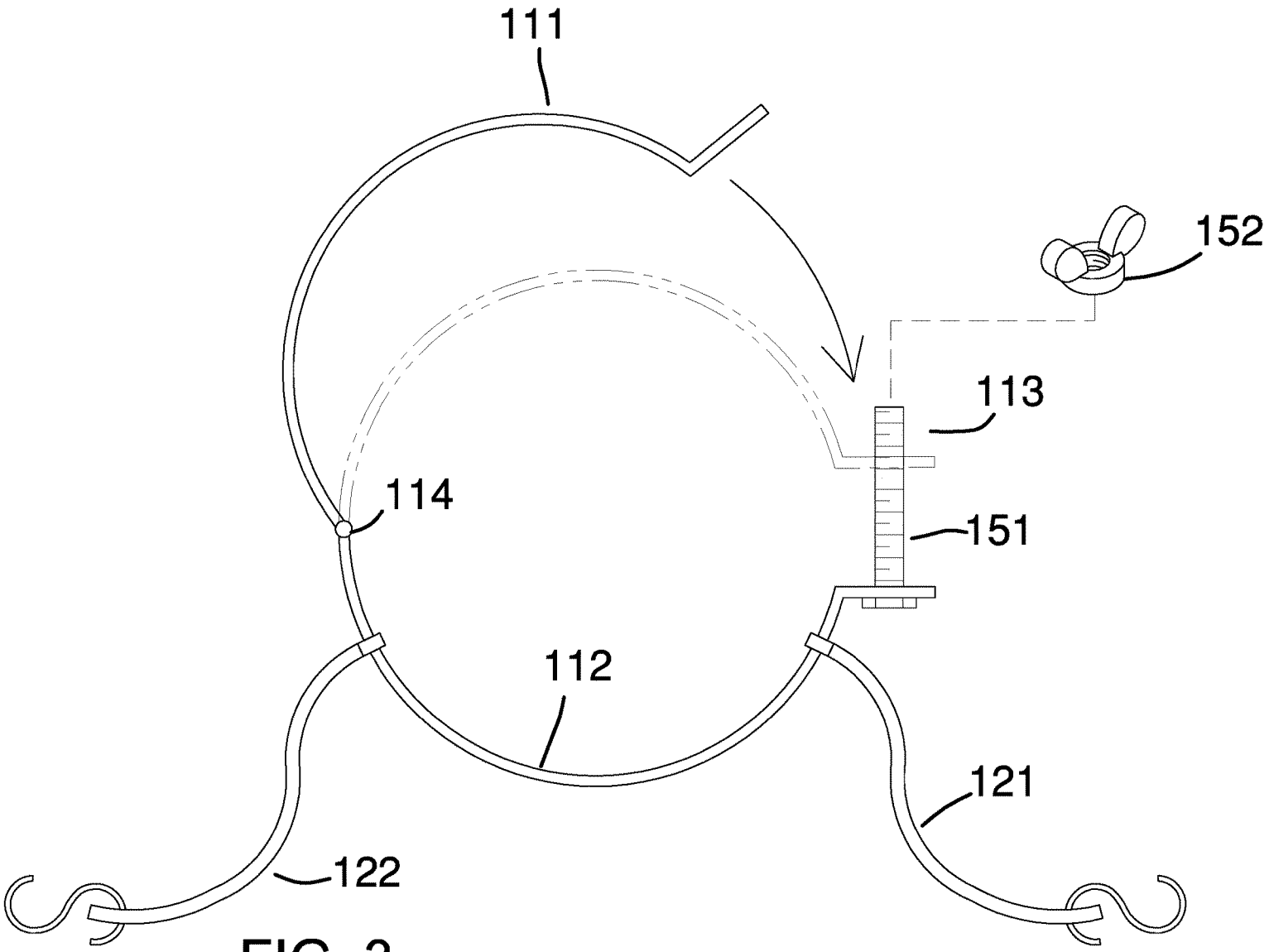
FIG. 3 is a detail view of an embodiment of the disclosure.
Figure 4:
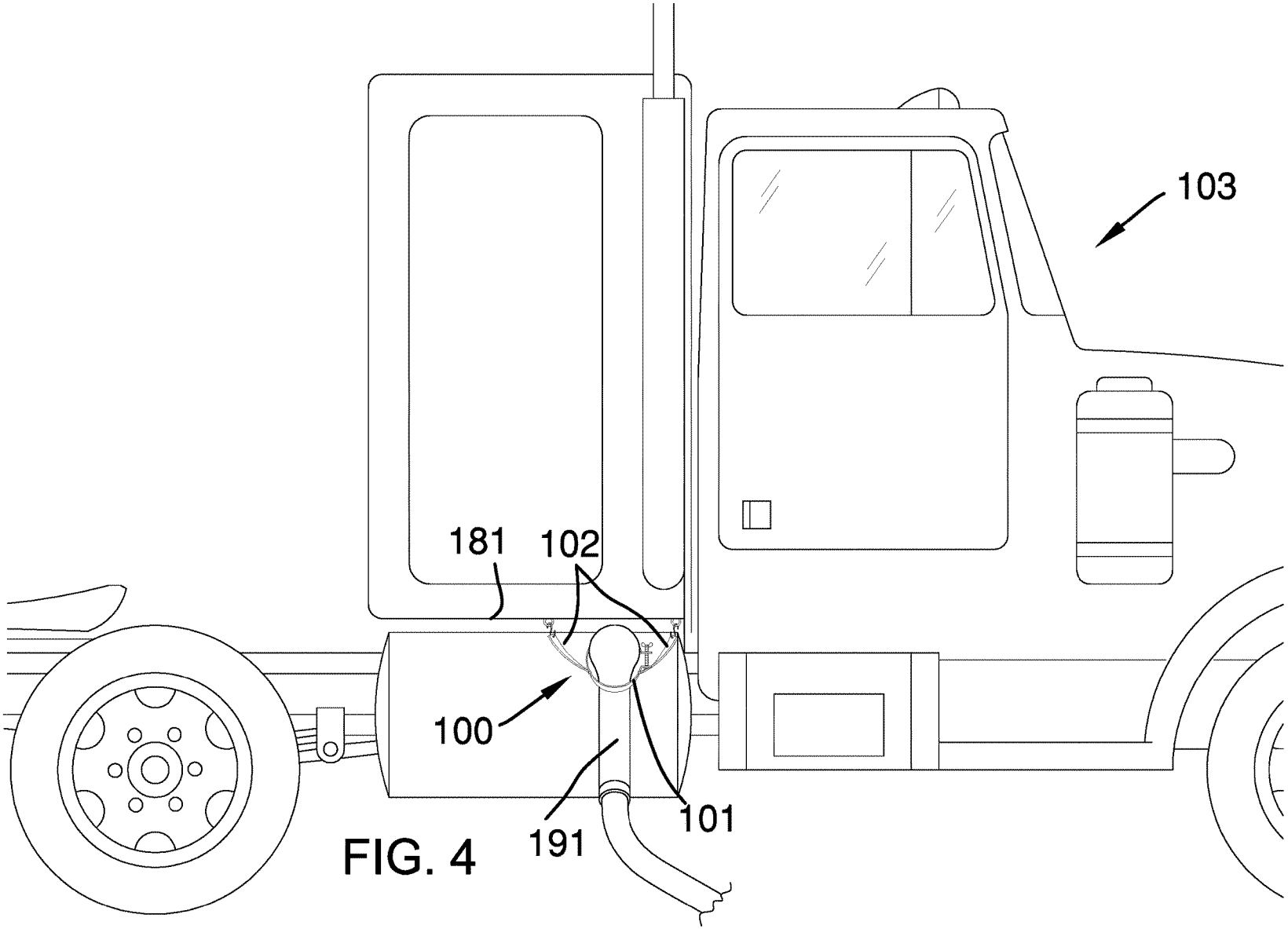
FIG. 4 is an in-use view of an embodiment of the disclosure.
Figure 5:
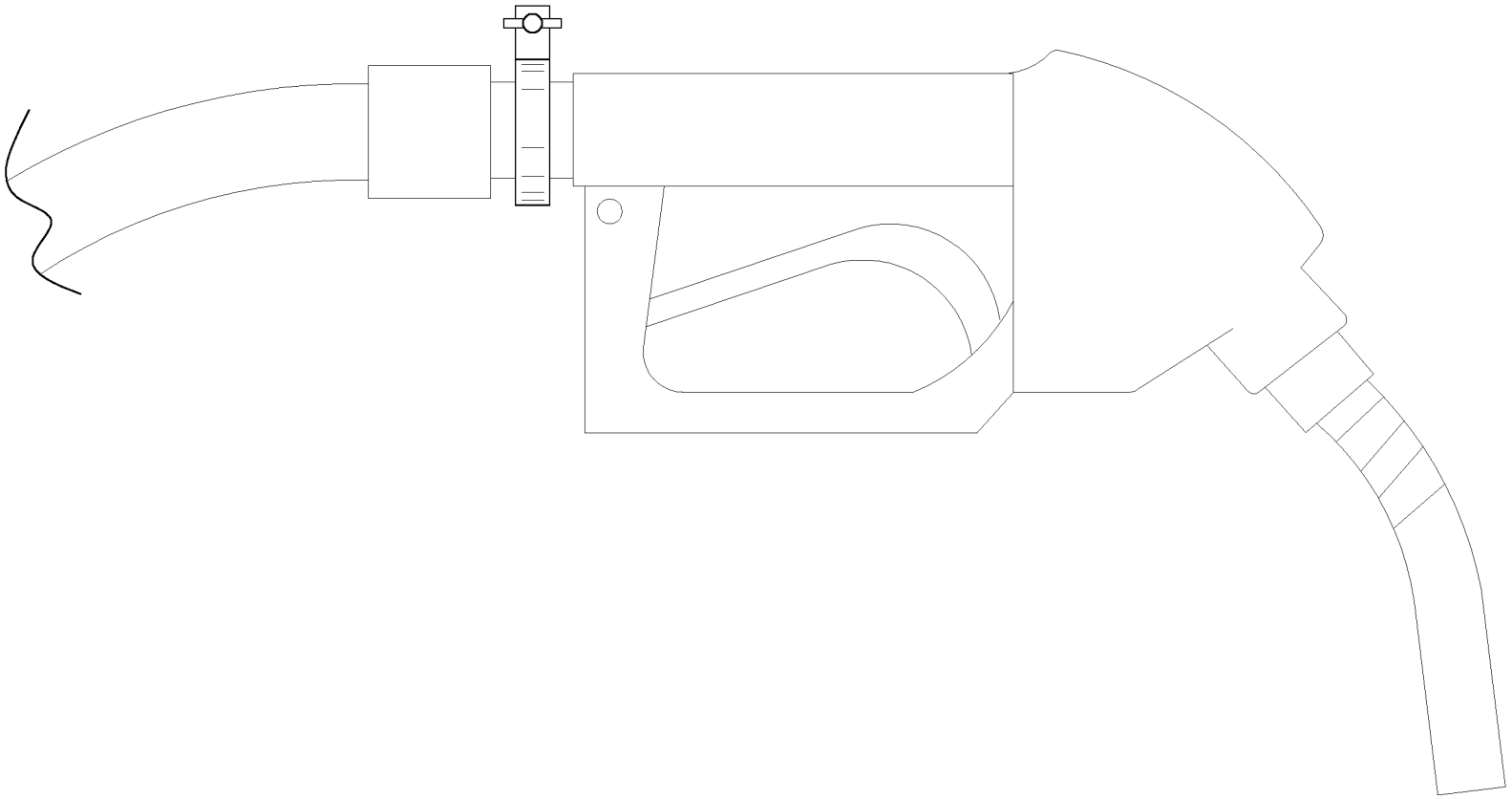
FIG. 5 is a side view of a device of the disclosure.

Detailed reference will now be made to one or more potential embodiments of the disclosure, which are illustrated in FIGS. 1 through 5.

The fuel pump holding strap 100 (hereinafter invention) is a mechanical device. The invention 100 is configured for use with a vehicle 103. The vehicle 103 further comprises a metal mesh screen flooring 181. The metal mesh screen flooring 181 forms a horizontal platform commonly used by the operator of a vehicle 103 for entering and exiting the vehicle 103. The invention 100 is configured for use with a fuel pump nozzle 191. The fuel pump nozzle 191 is a nozzle configured for use in dispensing fuel into the vehicle 103. The invention 100 comprises a pipe clamp 101 and a plurality of fastening structures 102. The pipe clamp 101 attaches the plurality of fastening structures 102 to the fuel pump nozzle 191. The plurality of fastening structures 102 secures the fuel pump nozzle 191 to the metal mesh screen flooring 181 such that the fuel pump nozzle 191 does dislodge during the fuel transfer process.

The metal mesh screen flooring 181 is defined in greater detail elsewhere in this disclosure. The fuel pump nozzle 191 is defined in greater detail elsewhere in this disclosure.

The pipe clamp 101 is a mechanical structure. The pipe clamp 101 is a rigid structure. The pipe clamp 101 is a roughly circular structure. The pipe clamp 101 rotates between a closed position and an open position. The pipe clamp 101 wraps around the fuel pump nozzle 191 to secure the plurality of fastening structures 102 to the fuel pump nozzle 191. The pipe clamp 101 comprises a first arm 111, a second arm 112, a threaded connector 113, and a hinge 114.

The first arm 111 and the second arm 112 are clamped around the fuel pump nozzle 191 to secure the invention 100 to the fuel pump nozzle 191. The first arm 111 rotates relative to the second arm 112 to rotate the pipe clamp 101 between the open position and the closed position.

The first arm 111 is a non-Euclidean metal structure. The first arm 111 has a roughly semicircular shape. The second arm 112 is a non-Euclidean metal structure. The first arm 111 comprises a first extension strip 131, a first hinge 114 end 132, a first spacer 134 plate 133, and a first spacer 134.

The first extension strip 131 is a rectangular strip structure. The first extension strip 131 is a non-Euclidean structure that curves along the major axis of the first extension strip 131. The first extension strip 131 forms a semicircular shape. The first extension strip 131 is a semi-rigid structure. The first extension strip 131 will apply pressure to the exterior surface of the fuel pump nozzle 191 as the threaded connector 113 is tightened.

The first hinge 114 end 132 is an edge of the first extension strip 131 that is parallel to the minor axis of the first extension strip 131. The first hinge 114 end 132 attaches to the hinge 114 of the pipe clamp 101.

The first spacer 134 plate 133 is a flat (Euclidean) plate. The first spacer 134 plate 133 has a square disk structure. The first spacer 134 plate 133 attaches to the end of the first extension strip 131 that is distal from the first hinge 114 end 132. The first spacer 134 plate 133 attaches to the first extension strip 131 such that the first spacer 134 plate 133 and the second spacer 144 plate 143 are parallel to and in contact with each other when the pipe clamp 101 is in a closed position The first spacer 134 is a circular negative space that is formed through the faces of the disk structure of the first extension strip 131. The first spacer 134 is sized such that the cylindrical threaded portion of the bolt 151 will insert through the first spacer 134. The first spacer 134 is sized such that the nut 152 will not insert through the first spacer 134.

The second arm 112 has a roughly semicircular shape. The first arm 111 and the second arm 112 form mirror images that join to form a circular shape. The second arm 112 comprises a second extension strip 141, a second hinge 114 end 142, a second spacer 144 plate 143, and a second spacer 144.

The second extension strip 141 is a rectangular strip structure. The second extension strip 141 is a non-Euclidean structure that curves along the major axis of the second extension strip 141. The second extension strip 141 forms a semicircular shape. The second extension strip 141 is a semi-rigid structure. The second extension strip 141 will apply pressure to the exterior surface of the fuel pump nozzle 191 as the hinge 114 is tightened.

The second hinge 114 end 142 is an edge of the second extension strip 141 that is parallel to the minor axis of the second extension strip 141. The second hinge 114 end 142 attaches to the hinge 114 of the pipe clamp 101.

The second spacer 144 plate 143 is a flat (Euclidean) plate. The second spacer 144 plate 143 has a square disk structure. The second spacer 144 plate 143 attaches to the end of the second extension strip 141 that is distal from the second hinge 114 end 142. The second spacer 144 plate 143 attaches to the second extension strip 141 such that the second spacer 144 plate 143 and the first spacer 134 are parallel to and in contact with each other when the pipe clamp 101 is in a closed position The second spacer 144 is a circular negative space that is formed through the faces of the disk structure of the second extension strip 141. The second spacer 144 is sized such that the cylindrical threaded portion of the bolt 151 will insert through the second spacer 144. The second spacer 144 is sized such that the nut 152 will not insert through the second spacer 144.

The first spacer 134 plate 133 and the second spacer 144 plate 143 are identical. The first spacer 134 and the second spacer 144 are identical.

The threaded connector 113 is a threaded connecting device. The threaded connector 113 attaches the second arm 112 to the first arm 111 such that the first arm 111 and the second arm 112 apply a radial pressure against the exterior surface of the fuel pump nozzle 191 that prevents the pipe clamp 101 from shifting while secured to the fuel pump nozzle 191. The threaded connector 113 comprises a bolt 151 and a nut 152.

The bolt 151 is a commercially available hardware item. The bolt 151 is defined in greater detail elsewhere in this disclosure. The nut 152 is a commercially available hardware item. The nut 152 is defined in greater detail elsewhere in this disclosure. The bolt 151 and the nut 152 are sized such that the bolt 151 screws into the nut 152. The bolt 151 and the nut 152 secure the first arm 111 to the second arm 112. The bolt 151 inserts through the first spacer 134 and then screws into the second spacer 144 before screwing into the nut 152.

The hinge 114 is a fastening structure. The hinge 114 attaches the first arm 111 to the second arm 112 such that the position of the first arm 111 rotates relative to the second arm 112.

Each of the plurality of fastening structures 102 is a mechanical structure. Each of the plurality of fastening structures 102 is an elastic structure. Each of the plurality of fastening structures 102 attaches to the metal mesh screen flooring 181 under tension such that the fuel pump nozzle 191 will not dislodge during the fuel transfer process. The plurality of fastening structures 102 comprises a first fastening structure 121 and a second fastening structure 122.

The first fastening structure 121 is an elastic structure. The first fastening structure 121 attaches the pipe clamp 101 to the fuel pump nozzle 191. A tension is maintained on the first fastening structure 121 during the attachment process such that the fuel pump nozzle 191 will not shift during the fuel transfer process. The first fastening structure 121 comprises a first elastic cord 161, a first clamp retainer 162, and a first S-hook 163.

The first elastic cord 161 acts as a spring. Specifically, when a force is applied to both ends of the first elastic cord 161 in a direction parallel to the center axis of the first elastic cord 161, the applied force elongates the span of the end to end length the first elastic cord 161 in the direction parallel to the center axis of the first elastic cord 161. The elasticity of the first elastic cord 161 creates a force that opposes the displacement created by the applied force. The elasticity of the first elastic cord 161 returns the first elastic cord 161 to its relaxed shape.

When the elongated first elastic cord 161 loops around the metal mesh screen flooring 181, the metal mesh screen flooring 181 will prevent the first elastic cord 161 from returning to its relaxed shape. In this circumstance, the first elastic cord 161 will apply a force projecting radially away from the center axis of the first elastic cord 161 and through the lateral face of the first elastic cord 161 and against the metal mesh screen flooring 181. This force binds the first elastic cord 161 to the metal mesh screen flooring 181. The first elastic cord 161 is defined in greater detail elsewhere in this disclosure.

The first clamp retainer 162 is a hardware item. The first clamp retainer 162 is a mechanical structure. The first clamp retainer 162 attaches a first end of the first elastic cord 161 to the second arm 112 of the pipe clamp 101. The first S-hook 163 is a hardware item commonly referred to as an S-hook. The first S-hook 163 secures a second end of the first elastic cord 161 to the fuel pump nozzle 191.

The second fastening structure 122 is an elastic structure. The second fastening structure 122 attaches the pipe clamp 101 to the fuel pump nozzle 191. A tension is maintained on the second fastening structure 122 during the attachment process such that the fuel pump nozzle 191 will not shift during the fuel transfer process. The first fastening structure 121 and the second fastening structure 122 are identical. The second fastening structure 122 comprises a second elastic cord 171, a second clamp retainer 172, and a second S-hook 173.

The second elastic cord 171 acts as a spring. Specifically, when a force is applied to both ends of the second elastic cord 171 in a direction parallel to the center axis of the second elastic cord 171, the applied force elongates the span of the end to end length the second elastic cord 171 in the direction parallel to the center axis of the second elastic cord 171. The elasticity of the second elastic cord 171 creates a force that opposes the displacement created by the applied force. The elasticity of the second elastic cord 171 returns the second elastic cord 171 to its relaxed shape.

When the elongated second elastic cord 171 loops around the metal mesh screen flooring 181, the metal mesh screen flooring 181 will prevent the second elastic cord 171 from returning to its relaxed shape. In this circumstance, the second elastic cord 171 will apply a force projecting radially away from the center axis of the second elastic cord 171 and through the lateral face of the second elastic cord 171 and against the metal mesh screen flooring 181. This force binds the second elastic cord 171 to the metal mesh screen flooring 181. The second elastic cord 171 is defined in greater detail elsewhere in this disclosure.

The second clamp retainer 172 is a hardware item. The second clamp retainer 172 is a mechanical structure. The second clamp retainer 172 attaches a first end of the second elastic cord 171 to the second arm 112 of the pipe clamp 101. The second S-hook 173 is a hardware item commonly referred to as an S-hook. The second S-hook 173 secures a second end of the second elastic cord 171 to the fuel pump nozzle 191.

The following definitions were used in this disclosure:

Bolt: As used in this disclosure, a bolt is a cylindrical shaft that is formed with an exterior screw thread. A bolt is defined with an outer diameter.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Closed Position: As used in this disclosure, a closed position refers to a movable barrier structure that is in an orientation that prevents passage through a port or an aperture. The closed position is often referred to as an object being "closed."

Disk: As used in this disclosure, a disk is a prism-shaped object that is flat in appearance. The disk is formed from two congruent ends that are attached by a lateral face. The sum of the surface areas of two congruent ends of the prism-shaped object that forms the disk is greater than the surface area of the lateral face of the prism-shaped object that forms the disk. In this disclosure, the congruent ends of the prism-shaped structure that forms the disk are referred to as the faces of the disk.

Elastic: As used in this disclosure, an elastic is a material or object that deforms when a force is applied to it and that is able to return to its relaxed shape after the force is removed. A material that exhibits these qualities is also referred to as an elastomeric material. A material that does not exhibit these qualities is referred to as inelastic or an inelastic material.

Elastic Cord: As used in this disclosure, an elastic cord is a cord that contains elastic yarns as some of the yarns that make up the cord. An elastic cord is constructed such that the elastic cord will stretch when a force is applied and will return to its original shape when after the force is removed. Shock cord and bungee cord are synonyms for elastic cord.

Elevation: As used in this disclosure, elevation refers to the span of the distance in the superior direction between a specified horizontal surface and a reference horizontal surface. Unless the context of the disclosure suggests otherwise, the specified horizontal surface is the supporting surface the potential embodiment of the disclosure rests on. The infinitive form of elevation is to elevate.

Extension Structure: As used in this disclosure, an extension structure is an inert physical structure that is used to extend or bridge the reach between any two objects.

Exterior Screw Thread: An exterior screw thread is a ridge wrapped around the outer surface of a tube in the form of a helical structure that is used to convert rotational movement into linear movement.

Fastener: As used in this disclosure, a fastener is a device that is used to join or affix a first object to a second object.

Force of Gravity: As used in this disclosure, the force of gravity refers to a vector that indicates the direction of the pull of gravity on an object at or near the surface of the earth.

Fuel: As used in this disclosure, fuel refers to a substance that undergoes a chemical combustion reaction to release chemical potential energy.

Grate: As used in this disclosure, a grate is a: 1) a plurality of parallel metal bars; or, 2) a metal structure comprising mesh structure formed from metal bars.

Hardware: As used in this disclosure, refers to one or more incidental objects: 1) that are readily and commercially available; and, 2) that are associated with the installation, operation or maintenance of a primary object. Always use incidental.

Hinge: As used in this disclosure, a hinge is a device that permits the turning, rotating, or pivoting of a first object relative to a second object.

Hook: As used in this disclosure, a hook is an object that is curved or bent at an angle such that items can be hung on or caught by the object.

Horizontal: As used in this disclosure, horizontal is a directional term that refers to a direction that is either: 1) parallel to the horizon; 2) perpendicular to the local force of gravity, or, 3) parallel to a supporting surface. In cases where the appropriate definition or definitions are not obvious, the second option should be used in interpreting the specification. Unless specifically noted in this disclosure, the horizontal direction is always perpendicular to the vertical direction.

Incidental: As used in this disclosure, incidental refers to a second object that is associated with a first object but that: 1) does not significantly affect the characteristics of the first object; and, 2) the function of which can be readily replaced by or substituted with a third object.

Interior Screw Thread: An interior screw thread is a groove that is formed around the inner surface of a tube in the form of a helical structure that is used to convert rotational movement into linear movement.

Load: As used in this disclosure, the term load refers to an object upon which a force is acting or which is otherwise absorbing energy in some fashion. Examples of a load in this sense include, but are not limited to, a mass that is being moved a distance or an electrical circuit element that draws energy. The term load is also commonly used to refer to the forces that are applied to a stationary structure.

Load Path: As used in this disclosure, a load path refers to a chain of one or more structures that transfers a load generated by a raised structure or object to a foundation, supporting surface, or the earth.

Major and Minor Axes: As used in this disclosure, the major and minor axes refer to a pair of perpendicular axes that are defined within a structure. The length of the major axis is always greater than or equal to the length of the minor axis. The major axis is always the longest diameter of the structure. The major and minor axes intersect at the center of the structure. The major axis is always parallel to an edge of a rectangular or rectilinear structure.

Mesh: As used in this disclosure, the term mesh refers to an openwork fabric made from threads, yarns, cords, wires, or lines that are woven, knotted, or otherwise twisted or intertwined at regular intervals. Synonyms for mesh include net and screen. A mesh structure formed from metal bars or wires is often referred to as a grate.

Metal Mesh Screen Flooring: As used in this disclosure, a metal mesh screen flooring is a horizontal openwork metal structure used as a load bearing surface or platform that is elevated above a supporting surface. Metal mesh screen flooring is also referred to a bar grating.

Non-Euclidean Structure: As used in this disclosure, a non-Euclidean structure is a structure wherein an axis of the structure lies on a non-Euclidean plane.

Nozzle: As used in this disclosure, a nozzle is a device that receives fluid under pressure and releases the fluid in a controlled manner into an environment.

Nut: As used in this disclosure, a nut is a first object that is formed with a cylindrical negative space that further comprises an interior screw thread such that a second object with a matching exterior screw thread can screw into the first object forming a threaded connection. A nut is further defined with an inner diameter.

Open Position: As used in this disclosure, an open position refers to a movable barrier structure that is in an orientation that allows passage through a port or an aperture. The open position is often referred to as an object being "open."

Orientation: As used in this disclosure, orientation refers to the positioning of a first object relative to: 1) a second object; or, 2) a fixed position, location, or direction.

Plate: As used in this disclosure, a plate is a smooth, flat and semi-rigid or rigid structure that has at least one dimension that: a) is of uniform thickness; and b) that appears thin relative to the other dimensions of the object. Plates often have a rectangular appearance. Plates often have a disk-like structure. The face of the plate is a surface of the plate selected from the group consisting of: a) the surface of the plate with the greatest surface area; b) the surface of the plate that is distal from the surface of the plate with the greatest surface area. The edges of the plate comprises the surfaces of the plate that would not be considered faces as defined above. As defined in this disclosure, plates may be made of any material, but are commonly made of metal, plastic, and wood. When made of wood, a plate is often referred to as a board or a plank.

Platform: As used in this disclosure, a platform is a raised horizontal surface that forms a load path to support objects placed on the superior surface of the platform.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Relaxed Shape: As used in this disclosure, a structure is considered to be in its relaxed state when no shear, strain, or torsional forces are being applied to the structure.

Rigid Structure: As used in this disclosure, a rigid structure is a solid structure formed from an inelastic material that resists changes in shape. A rigid structure will permanently deform as it fails under a force.

Screw: As used in this disclosure, to screw is a verb meaning: 1) to fasten or unfasten (unscrew) a threaded connection; or 2) to attach a helical structure to a solid structure.

Semi-Rigid Structure: As used in this disclosure, a semi-rigid structure is a solid structure that is stiff but not wholly inflexible and that will deform under force before breaking. A semi-rigid structure may or may not behave with an elastic nature in that a semi-rigid structure need not return to its relaxed shape.

Spacer: As used in this disclosure, a spacer is a prism-shaped disk that is formed with a cylindrical negative space that allows a shaft to insert through the faces of the disk. A spacer is further defined with an inner diameter.

Strip: As used in this disclosure, the term describes a long and narrow object of uniform thickness that appears thin relative to the length of the object. Strips are often rectangular in shape.

Supporting Surface: As used in this disclosure, a supporting surface is a horizontal surface upon which an object is placed and to which the load path of the object is transferred.

This disclosure assumes that an object placed on the supporting surface is in an orientation that is appropriate for the normal or anticipated use of the object.

Threaded Connection: As used in this disclosure, a threaded connection is a type of fastener that is used to join a first cylindrical object and a second cylindrical object together. The first cylindrical object is fitted with a first fitting selected from an interior screw thread or an exterior screw thread. The second cylindrical object is fitted with the remaining screw thread. The cylindrical object fitted with the exterior screw thread is placed into the remaining cylindrical object such that: 1) the interior screw thread and the exterior screw thread interconnect; and, 2) when the cylindrical object fitted with the exterior screw thread is rotated the rotational motion is converted into linear motion that moves the cylindrical object fitted with the exterior screw thread either into or out of the remaining cylindrical object. The direction of linear motion is determined by the direction of rotation.

Vehicle: As used in this disclosure, a vehicle is a motorized device used for transporting passengers, goods, or equipment. The term motorized vehicle refers to a vehicle can move under power provided by an electric motor or an internal combustion engine.

Vertical: As used in this disclosure, vertical refers to a direction that is either: 1) perpendicular to the horizontal direction; 2) parallel to the local force of gravity; or, 3) when referring to an individual object the direction from the designated top of the individual object to the designated bottom of the individual object. In cases where the appropriate definition or definitions are not obvious, the second option should be used in interpreting the specification. Unless specifically noted in this disclosure, the vertical direction is always perpendicular to the horizontal direction.

With respect to the above description, it is to be realized that the optimum dimensional relationship for the various components of the invention described above and in FIGS. 1 through 5 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A securing strap comprising:

a pipe clamp and a plurality of fastening structures;

wherein the plurality of fastening structures attach to the pipe clamp;

wherein the securing strap is configured for use with a vehicle;

wherein the securing strap is configured for use with a fuel pump nozzle;

wherein the plurality of fastening structures comprises a first fastening structure and a second fastening structure;

wherein the first fastening structure is an elastic structure;

wherein the second fastening structure is an elastic structure;

wherein the first fastening structure attaches the pipe clamp to the vehicle;

wherein the second fastening structure attaches the pipe clamp to the vehicle;

wherein a tension is maintained on the first fastening structure during the attachment process such that the fuel pump nozzle will not shift during the fuel transfer process;

wherein a tension is maintained on the second fastening structure during the attachment process such that the fuel pump nozzle will not shift during the fuel transfer process;

wherein the first fastening structure and the second fastening structure are identical.

2. The securing strap according to claim 1 wherein the pipe clamp is configured to attach the plurality of fastening structures to the fuel pump nozzle;

wherein the plurality of fastening structures are configured to secure the fuel pump nozzle to a metal mesh screen flooring of a vehicle such that the fuel pump nozzle does dislodge during the fuel transfer process.

3. The securing strap according to claim 2 wherein the pipe clamp rotates between a closed position and an open position.

4. The securing strap according to claim 3 wherein the pipe clamp wraps around the fuel pump nozzle to secure the plurality of fastening structures to the fuel pump nozzle.

5. The securing strap according to claim 4 wherein each of the plurality of fastening structures is an elastic structure;

wherein each of the plurality of fastening structures attaches to a metal mesh screen flooring of a vehicle under tension such that the fuel pump nozzle will not dislodge during the fuel transfer process.

6. The securing strap according to claim 5 wherein the pipe clamp comprises a first arm, a second arm, a threaded connector, and a hinge;

wherein the hinge attaches the first arm to the second arm;

wherein the threaded connector secures the first arm to the second arm in the closed position.

7. The securing strap according to claim 6 wherein the first arm rotates relative to the second arm to rotate the pipe clamp between the open position and the closed position;

wherein the first arm and the second arm are clamped around the fuel pump nozzle to secure the securing strap to the fuel pump nozzle.

8. The securing strap according to claim 7 wherein the first arm comprises a first extension strip, a first hinge end, a first spacer plate, and a first spacer;

wherein the first hinge end and the first spacer plate are formed on the first extension strip;

wherein the first spacer is formed in the first spacer plate;

wherein the second arm comprises a second extension strip, a second hinge end, a second spacer plate, and a second spacer;

wherein the second hinge end and the second spacer plate are formed on the second extension strip;

wherein the second spacer is formed in the second spacer plate.

9. The securing strap according to claim 8 wherein the first extension strip is a rectangular strip structure;

wherein the second extension strip is a rectangular strip structure;

wherein the first extension strip curves along the major axis of the first extension strip;

wherein the second extension strip that curves along the major axis of the second extension strip;

wherein the first extension strip forms a semicircular shape;

wherein the second extension strip forms a semicircular shape.

10. The securing strap according to claim 9 wherein the first hinge end is an edge of the first extension strip that is parallel to the minor axis of the first extension strip;

wherein the second hinge end is an edge of the second extension strip that is parallel to the minor axis of the second extension strip;

wherein the first hinge end attaches to the hinge of the pipe clamp;

wherein the second hinge end attaches to the hinge of the pipe clamp.

11. The securing strap according to claim 10 wherein the first spacer plate is a flat (Euclidean) plate;

wherein the first spacer plate attaches to the end of the first extension strip that is distal from the first hinge end;

wherein the second spacer plate is a flat (Euclidean) plate;

wherein the second spacer plate attaches to the end of the second extension strip that is distal from the second hinge end.

12. The securing strap according to claim 11 wherein the first spacer plate attaches to the first extension strip such that the first spacer plate and the second spacer plate are parallel to and in contact with each other when the pipe clamp is in a closed position;

wherein the second spacer plate attaches to the second extension strip such that the second spacer plate and the first spacer are parallel to and in contact with each other when the pipe clamp is in a closed position.

13. The securing strap according to claim 12 the first spacer is a circular negative space that is formed through the faces of the disk structure of the first extension strip;

the second spacer is a circular negative space that is formed through the faces of the disk structure of the second extension strip.

14. The securing strap according to claim 13 wherein the first spacer plate and the second spacer plate are identical;

wherein the first spacer and the second spacer are identical.

15. The securing strap according to claim 14 wherein the hinge is a fastening structure;

wherein the hinge attaches the first arm to the second arm such that the position of the first arm rotates relative to the second arm.

16. The securing strap according to claim 15 wherein the threaded connector is a threaded connecting device;

wherein the threaded connector attaches the second arm to the first arm such that the first arm and the second arm apply a radial pressure against the exterior surface of the fuel pump nozzle that prevents the pipe clamp from shifting while secured to the fuel pump nozzle.

17. The securing strap according to claim 16 wherein the threaded connector comprises a bolt and a nut;

wherein the bolt and the nut are sized such that the bolt screws into the nut;

wherein the bolt and the nut secure the first arm to the second arm;

wherein the first spacer is sized such that the cylindrical threaded portion of the bolt will insert through the first spacer;

wherein the first spacer is sized such that the nut will not insert through the first spacer;

wherein the second spacer is sized such that the cylindrical threaded portion of the bolt will insert through the second spacer;

wherein the second spacer is sized such that the nut will not insert through the second spacer;

wherein the bolt inserts through the first spacer and then screws into the second spacer before screwing into the nut.

18. The securing strap according to claim 17 wherein the first fastening structure comprises a first elastic cord, a first clamp retainer, and a first S-hook;

wherein the first clamp retainer attaches a first end of the first elastic cord to the second arm of the pipe clamp;

wherein the first S-hook secures a second end of the first elastic cord to the fuel pump nozzle.

19. The securing strap according to claim 18 wherein the second fastening structure comprises a second elastic cord, a second clamp retainer, and a second S-hook;

wherein the second clamp retainer is a mechanical structure;

wherein the second clamp retainer attaches a first end of the second elastic cord to the second arm of the pipe clamp;

wherein the second S-hook secures a second end of the second elastic cord to the fuel pump nozzle.

* * * * *